US012570418B2

(12) United States Patent
Conomos

(10) Patent No.: US 12,570,418 B2
(45) Date of Patent: Mar. 10, 2026

(54) BAG FILLING MACHINE

(71) Applicant: Peter Conomos, Bayview Heights (AU)

(72) Inventor: Peter Conomos, Bayview Heights (AU)

( * ) Notice: Subject to any disclaimer, the term of this patent is extended or adjusted under 35 U.S.C. 154(b) by 0 days.

(21) Appl. No.: 18/465,052

(22) Filed: Sep. 11, 2023

(65) Prior Publication Data

US 2024/0083606 A1 Mar. 14, 2024

(30) Foreign Application Priority Data

Aug. 25, 2023 (AU) ..... 2023219980

(51) Int. Cl.
*B65B 43/54* (2006.01)
*B65B 1/06* (2006.01)

(52) U.S. Cl.
CPC ..... *B65B 1/06* (2013.01); *B65B 43/54* (2013.01)

(58) Field of Classification Search
CPC .... B65G 2201/04; B65G 65/06; B65G 67/04; B65G 2201/045; B65B 1/04; B65B 67/04; B65B 43/54
See application file for complete search history.

(56) References Cited

U.S. PATENT DOCUMENTS 1,550,365 A * 8/1925 Jones ..... B65G 65/00 198/612
2,141,147 A * 12/1938 Clarkson ..... B65G 65/00 198/522
2,425,695 A * 8/1947 Fees ..... B65G 65/00 198/308.1
2005/0076971 A1 4/2005 Summerville

FOREIGN PATENT DOCUMENTS

| | | |
|---|---|---|
| CN | 102700951 | 4/2014 |
| CN | 203845027 | 9/2014 |
| CN | 206068955 | 4/2017 |
| CN | 207361372 | 5/2018 |
| CN | 108946195 | 12/2018 |
| CN | 209023228 | 6/2019 |
| CN | 213229272 | 5/2021 |

OTHER PUBLICATIONS

Examination report in related AU application 2023219980, Dec. 12, 2023, 7 pp.

(Continued)

*Primary Examiner* — Jason K Niesz
(74) *Attorney, Agent, or Firm* — Tredecim LLC; Sean L. Sweeney

(57) ABSTRACT

Disclosed herein is a bag filling apparatus for use by a person to fill bags of a flowable material, including a hand operation control means and a directing means including a first part for contact with the flowable material in the location, able to direct and move the flowable material towards a second part. In use the person can move the first part of the directing means into contract with the flowable material by moving by hand the machine into contact, and the directing means moves the flowable material from the location towards a location where a bag may be filled. In addition, variants thereon and methods of use for the bag filling apparatus are disclosed.

8 Claims, 6 Drawing Sheets

(56) References Cited

OTHER PUBLICATIONS

Best available translation of foreign reference CN203845027 , 4 pp.
Best available translation of foreign reference CN207361372 , 8 pp.
Best available translation of foreign reference CN209023228 , 4 pp.
Best available translation of foreign reference CN102700951 , 6 pp.
Best available translation of foreign reference CN206068955 , 4 pp.
Best available translation of foreign reference CN108946195 , 6 pp.
Best available translation of foreign reference CN213229272 , 5 pp.

* cited by examiner

BAG FILLING MACHINE

BACKGROUND TO THE INVENTION

The present invention relates to a bag filing machine, and in particular to a bag filling machine that may be used by an individual and controlled by hand.

Often it may be useful to fill a bag with material. The material may be sand, for example, to fill numerous sand bags as may be required to act against the ingress of water in a storm. Councils, emergency services, and other groups often will provide a pile of sand and empty bags for a person to fill. Sand is heavy and awkward to convey efficiently into a bag. If only a single bag were needed this may not be such a problem to shovel by hand, but for the use in a potential flood or storm a great many sand bags will be needed to be filled for use. Where the council may be assisting people to do so they may be filling hundreds of bags, which is hard physical work and will take a considerable length of time.

On a mine site or construction site, flowable materials such as gravel or sand may be moved in large volumes from one location to another, through use of large expensive equipment. Use of a loader or other large earthmoving machinery may be used, and in some cases tipper trucks to be filled with the material, before it is driven to another location and tipped out somewhere else for use. These large pieces of equipment are suitable on a mine site, but may be too costly for councils or smaller business or for emergency use. Further, in an emergency there needs to be ready access to the equipment, which may not be possible due to location.

Some large machinery may be known that includes a means to pick up flowable material, or may include a conveyor. However, large mining machines are very costly, and require large storage areas and large areas in which to work. There has long been a need for an improved method to fill sand bags and the like that automates the process, when compared to hand shoveling, in a compact and hand operated or personal operated way. Such a small machine may then be purchased by a council, or similar organisation, for regular use in day-to-day construction as well as being an essential part of their emergency deployment for use to rapidly fill sand bags for distribution. Due to the easy use by any person with minimal training, and the small profile, the machine can rapidly be deployed across a city in an emergency, located in many locations even if only a small area is available for the pile of sand to give access, and will dramatically improve the ability to quickly fill the sand bags. The invention provides a cost effective and realistic solution to a real problem.

The invention removes the need for the large earthmoving equipment, and, due to the inventive machines compact size, enables access to restricted spaces. The inventor has designed a small, personal machine that is easy to operate, so that a person could readily make use of it as need be, which compares to large mining machines that require lengthy training and certification before use may be made of the machine. The small personal machine means it can be used on a roadside or other suitable location for emergency sand bag deployment as often is the case when a storm or a cyclone is imminent or there is a high risk of flooding. The subject invention is quick and easy to use but is powered and automated so that the sand bags can be filled quickly and distributed where needed. A person can come along and quickly fill some bags and get back to their property at the earliest time to install the sand bags and hopefully for flood prevention. The compact design of the inventive apparatus allows for one or several to operate simultaneously at the same pile, approaching from all sides without clashing. In this way access to the pile is maximised, and bags and can be filled efficiently.

When compared to hand filling the sand bags the invention is a dramatic improvement. Use of large machinery or vehicles may be able to relieve the physical burden on a person when needing to fill numerous sand bags, but these large, costly and cumbersome machines and so are just not a practical solution to this problem. Further, public safety may be at risk in uncontrolled conditions such as an emergency where heavy machinery may be operated.

Through clever design and hand operated features, the inventor has provided a new way to fill sand bags much more easily than by hand, and in a machine that is suitable for domestic, council or other business use. The machine is easily moved by a single person, by hand and yet is a powerful machine that can run economically, efficiently and safely for many hours to fill the necessary bags, as required. The invention is likely to be very well received by the target market once known about, and will replace conventional hand filling methods.

The following describes a non-limiting example of the invention being used with reference to filling sand bags as a particularly useful application of the invention. However, the subject invention is a surprisingly clever and useful way to fill bags, or any receptacle, with any kind of flowable material. It is not intended that the invention be limited in anyway including to use for sand bags, other than is defined in the claims to invention. The invention may be useful in a wide range of application and industries.

For clarity, any prior art referred to herein, does not constitute an admission that the prior art forms part of the common general knowledge, in Australia or elsewhere.

It is an object of the present invention to provide a bag filling machine that at least ameliorates one or more of the aforementioned problems of the prior art. It is a further and separate object of the present invention to provide a method of use of a bag filling machine that at least ameliorates one or more of the aforementioned problems of the prior art.

SUMMARY OF THE INVENTION

Accordingly, the present invention provides a bag filling machine for use by a person to fill bags of a flowable material, the bag filling machine including:

- a hand operation control means; and
- a directing means including a first part for contact with the flowable material in the location, able to direct and move the flowable material towards a second part;

wherein, the person can move the first part of the directing means into contract with the flowable material by moving by hand the machine into contact, and the directing means moves the flowable material from the location towards a location where a bag may be filled.

Accordingly, the present invention also provides a bag filling machine for use by a person to fill bags of a flowable material, the bag filling machine including:

- a hand operation control means;
- a directing means including a first part for contact with the flowable material in the location, able to direct and move the flowable material towards a second part;
- a bag means in fluid communication with the second part of the directing means and able to receive flowable material therefrom;

wherein, the person can move the first part of the directing means into contract with the flowable material by moving by hand the machine into contact, and the directing means moves the flowable material from the location towards the bag means, enabling efficient filling thereof.

Accordingly, the present invention further provides in a variant, a bag filling apparatus for use by a person to fill bags of a flowable material, the bag filling machine including:

a hand operation control means; and a directing means including a conveyor with a plurality of material capturing pockets, and the directing means includes a first part for contact with the flowable material in the location, able to capture the material in the pockets and direct and move the flowable material towards a second part;

wherein, the person can move the first part of the directing means into contact with the flowable material by moving by hand the machine into contact, and the directing means moves the flowable material from the location towards a location where a bag may be filled.

Preferably, the bags to be filled are sand bags. The bag may be any suitable kind of bags. The flowable material may be any suitable material. The flowable material may be sand, as a particularly useful example of the invention. However, it is envisaged that there may be many other uses for this clever new invention, whereby any flowable material may be picked up and bagged through use of the apparatus. Therefore, the flowable material may be chosen from the group: edible grains; grains of any kind; gravel; mulch; pebbles; soil; sugar; wood chips; or any combination or mixed materials.

The flowable material may be very small particulates, such as sand, or may be larger rocks or pebbles. The directing means can be adapted to suit the particular material to be directed.

The hand operation may include holding a handle by the hand by the person. The hand control may include any suitable means the person can control individually the machine to fill bags. Preferably, the hand operation includes the person pushing and pulling the machine into the flowable material. The movement may be any suitable movement. The person can use their hands to move the machine in any suitable way. The machine may be driven by the person pushing and pulling on the handle in 360 degrees for a full maneuverability.

Preferably, the operation is manual by the person, not including any vehicle or large machinery that would limit the scope of use of the invention. Optionally, the subject invention may be used in conjunction with other equipment, either machinery or manual such as a wheel barrow, as appropriate. Optionally, the hand operation is the hand guidance of the apparatus, with some additional forward and backward movement provided by a motor or similar. In this case a motor may be included in the apparatus. The motor may be a petrol motor, electric motor or similar. Any suitable additional power may be supplied as would be useful. Batteries may be included for some forms of the invention.

The hand operation control may include button controls. The hand operation may include lever controls. The controls may be on the handle. The button controls may be at a separate location to the handle. There may be multiple handles. Where the optional power supply is included in the invention the control of the power may be through any suitable control. The power supply may be controlled with buttons or levers as appropriate. The controls of the power supply may be provided on the handle as convenient for use. The controls for the power supply may include a throttle. The controls for the power supply may include an accelerator. Any suitable controls to increase or decrease the power supply, speed or force of the apparatus through use of the power source may be included. The controls may include controls to control the conveyor. The controls may be controls for any of the controllable parts of the apparatus. The controls may include control of the conveyor driver or other parts to increase or decrease the speed of conveying the flowable material.

Where motorisation is included, the motorisation will still be very much controlled by hand, to keep the compact and usability features of the apparatus. A large vehicle would not be suitable, but a hand controlled motorised or manual apparatus has significant advantages over the prior art.

Preferably, safety features such as an emergency stop button may be included at any suitable location on the apparatus. Preferably, a safety shutdown feature is readily accessible by the user in use. The handle may include one or more safety shutdown controls.

Preferably, the directing means includes a conveyor to convey the flowable material from one place to another. Preferably, the directing means includes a front part (the first part) suitable to contact flowable material and cause some to be directed onto the machine. The first part may take any suitable form. The first part may contact the material any suitable way to enable the flowable material to be directed on to the machine.

Preferably, the flowable material is directed from the front towards an area where a bag can be filled (the second area). Preferably, the flowable material is directed upwards away from the front. The second area may take any suitable form. Preferably, the flowable material is directed from the front towards a top. Preferably, at the top the material may flow under gravity into a container. Preferably, the material may flow from a top via a chute into a container.

Preferably, capture means are included associated with the front of the machine. Preferably, the capture means are a plurality of pockets, recesses or containers able to capture the material and through use of the directing means move the captured material from the front of the machine towards the bagging area. Preferably, a plurality of material capturing pockets are included. Preferably, a plurality of material capturing pockets are included, associated with the front of the machine, and with the directing means so that captured material is moved from the front of the machine once captured and directed towards the bagging area. Preferably, a plurality of capture pockets is included. Preferably, the capture pockets are associated with the directing means. Preferably, the capturing pockets are associated with the front of the machine. Preferably, a plurality of capture pockets is included in a conveyor of the directing means of the apparatus. Preferably, the plurality of material capturing pockets is pockets cast substantially along the length of the conveyor, whereby as the conveyor runs when the front is in contact with the flowable material can be captured in the pockets continually, and directed away.

Most preferably, a plurality of capturing pockets is included on the directing means. Preferably, the plurality of capturing pockets is configured so that as the front of the machine contacts the material, the material is carried with the direction means/conveyor up and away towards the bagging area. Most preferably, a cover or protective part is included so that as material is captured from the front of the machine and directed up and away, the cover or protection acts to assist in retaining the captured material.

Preferably, the container is a bag. However, any suitable container can be used, including a fixed container, moveable container such as a wheel barrow, or a container with hard sides. The particular container used with the invention does not change the scope of the invention. The bag may be omitted and provided separately. The bag means need not form part of the invention.

A bag filling apparatus for use by a person to fill bags of a flowable material, the bag filling machine including:

a hand operation control means, to operate the machine on or off including wheels, caterpillar tracks or similar powered by a motor to move the machine forward and back on control; and a directing means including a conveyor with a plurality of material capturing pockets, controlled by the hand operation control means to cause the conveyor to run, and the directing means includes a first part for contacting the pockets with the flowable material in the location, able to capture the material in the pockets and direct and move the flowable material upwards towards a bagging area in a second part where the material can fall under gravity into a bag below;

wherein, the person can move the first part of the directing means into contact with the flowable material by moving by hand the machine into contact, and the directing means moves the flowable material from the location towards a location where a bag may be filled, and removed.

Accordingly, the invention provides a method of using a bag filling apparatus, the bag filling apparatus including a hand operation control means and a directing means, the method including the following steps":

a) Taking the handle for operation of the machine;

b) Moving the directing means into the flowable material; and c) Causing the directing means to move the flowable material towards a location where a bag can be filled with the flowable material and once filled removed.

The bag filling apparatus of the method may be the bag filling apparatus of the invention in any of its forms or variants.

BRIEF DESCRIPTION OF THE DRAWINGS

The invention will now be described in connection with non-limiting preferred embodiments with reference to the accompanying drawings, in which.

DETAILED DESCRIPTION OF THE INVENTION

Figure 1:
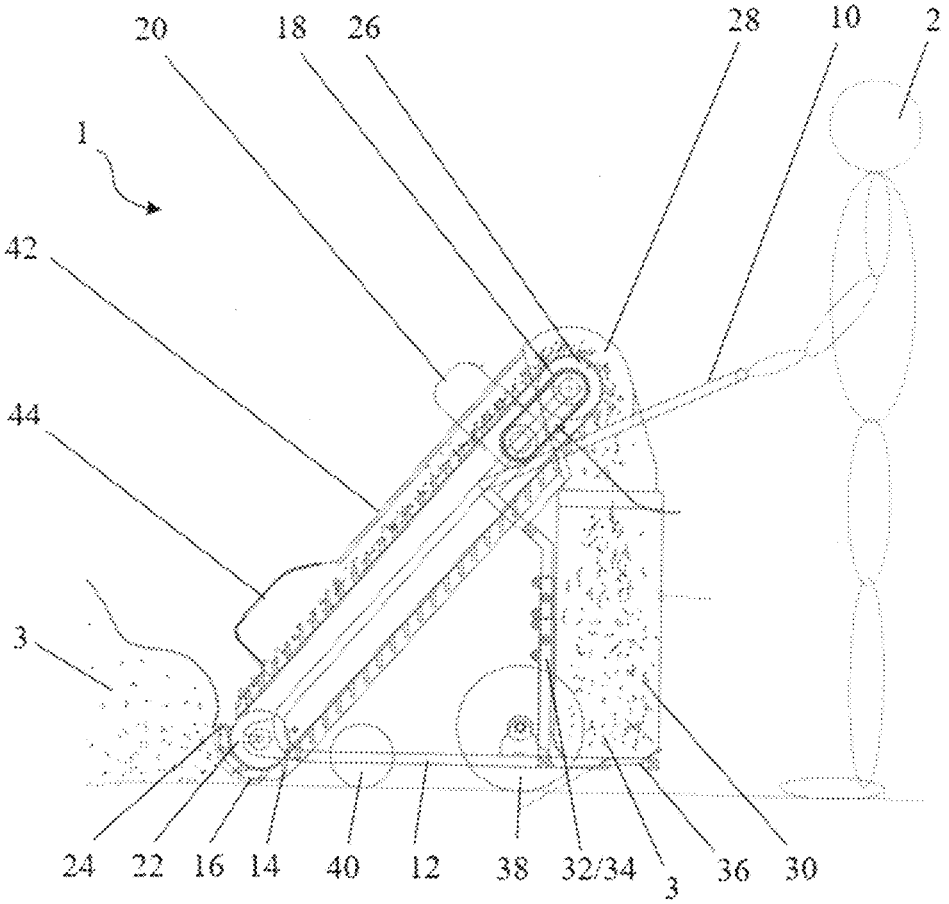
FIG. 1 is a side view of a bag filling machine according to a preferred embodiment of the invention shown in use by a person for filling a pile of sand into a bag.
Figure 2:
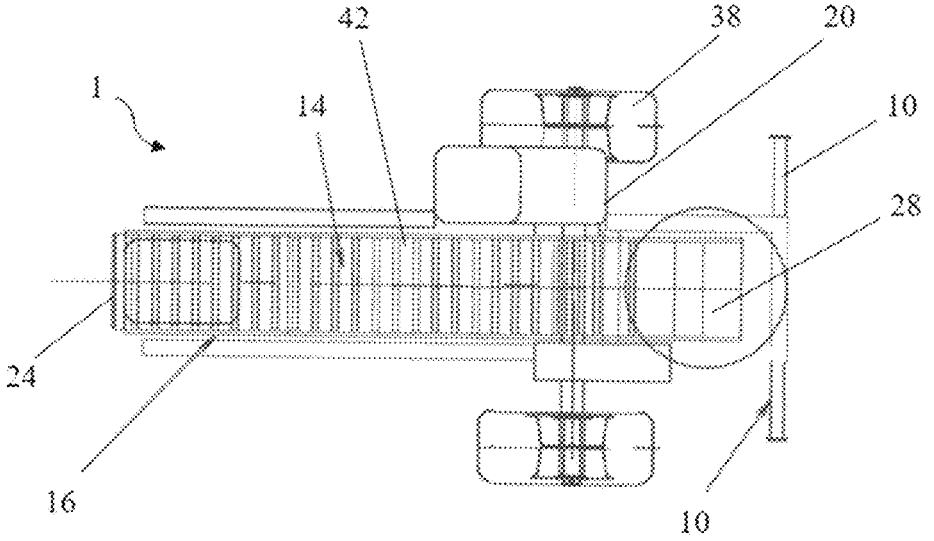
FIG. 2 is a plan view from above of the bag filling machine of FIG. 1 with the person and sand omitted for ease of illustration.
Figure 7:
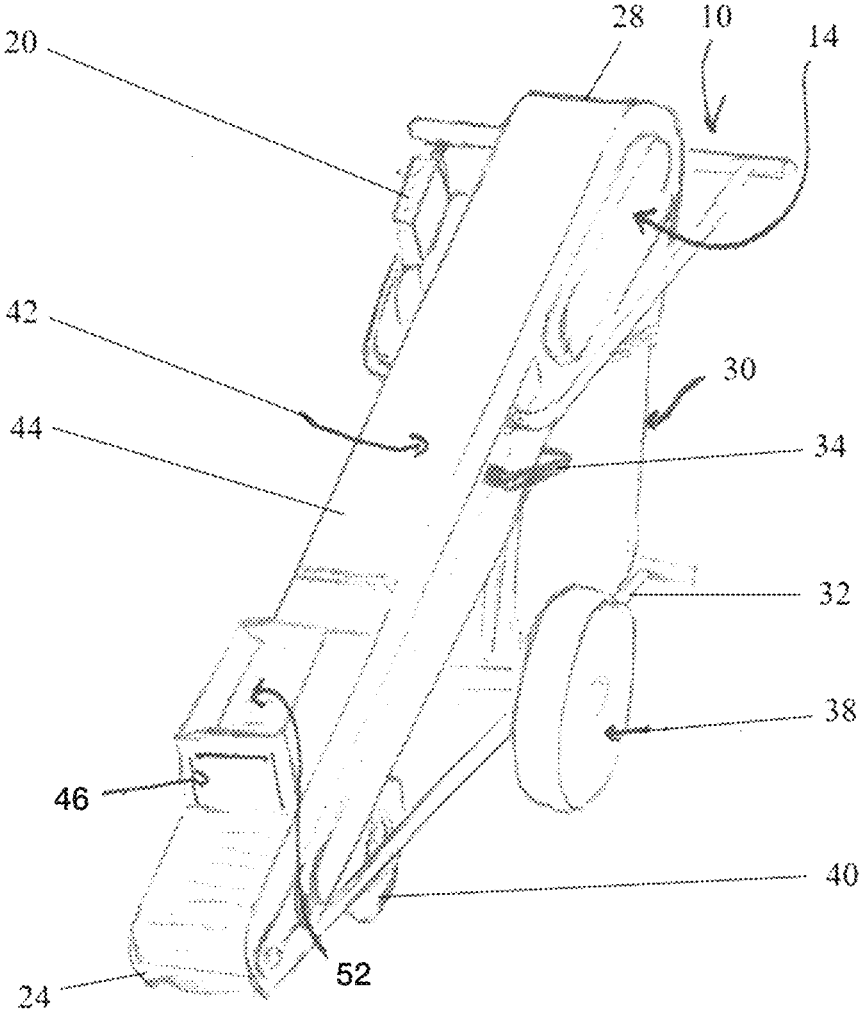
FIG. 7 is a schematic perspective view of the invention of FIGS. 1 and 2, with the person and sand omitted illustrating, in particular, the hand operation through the hand used to direct the machinery into the sand, so that the sand can be picked up and the bags filled.

Referring to FIGS. 1, 2 and 7, a first preferred embodiment of the invention will be described, where bag filling machine 1, for use by person 2 (shown schematically) on sand 3 from a sand pile, not separately labelled. The invention is an individually controlled machine that can be used to fill bags of material, such as sand in a most convenient way. Whereas a council may not be able to have ready access to large machines or vehicles, the machine of the subject invention is a far more economic apparatus that can be kept on hand where needed. The small foot-print and maneuverability allows the machine to be go through to where people need it to fill sand bags, this would simply not be possible for the large scale industrial machines available, which need a very large area to be able to get in and out of a location. The small size of the machine and single person manual operation means several can be used at the same time at a sand pile to maximise the filling of sand bags, so they can be taken away and used. In an emergency such as a cyclone about to hit, or potential flooding events, time is critical and the quicker the sand bagging can be deployed to numerous locations so more people can get bags filled quickly means more people have the chance to prepare properly before the emergency event occurs. Sometimes there is only a matter of hours to deploy safety equipment and get the sand bags, filled and in place. The subject invention will be incredibly useful in this event at the machines will be kept locally and can be very quickly deployed to where needed, used and then kept being used until no longer needed or the emergency means that everyone must take cover. Again the small and easy machines mean that these can be quickly put away when the cyclone or flood is occurring and then once it is safe to do so again bring out the machines for further use to reinforce banks or further support doors and banks against the emergency event. While the technology may seem less complex than existing machines this does not diminish the value of this very useful new invention that can be readily used, stored, transported and at a much lower cost than existing vehicles.

Manual control by person 2 has significant advantages over filling the bags by hand with a shovel, and large machines are often not suitable or may not be accessible where a person needs to fill the bags. The present invention instead provides a convenient machine that is able to be used at smaller sites, such as a council site. Further, for small businesses the invention will be most useful, where the cost of a large machine (which may only be used a few times a year) would otherwise be prohibitive to purchase and due to the need for registration and licenses to operate.

Bag filling machine 1, has handle 10, connected to frame 12 and it is through handle 10 that person 2 can easily manipulate and move the bag machine to effectively fill bags. Frame 12 with handle 10 form the strong basis for the machine to enable manipulation by a person by hand without the need for a vehicle engine or movement. The advantage to a shovel is that sand 3 can be shoveled even in small amounts into a bag and easily be manipulated in small areas. The cost of use of shovel is also low, but it is hard work and after a while the person will tire. If many bags are to be filled then using a shovel may quickly become a problem. Emergency situations may lead to people who are not used to physical activity needing to be involved in filling sand bags, which is hard physical work. Such intense bursts of physical activity can result in many injuries, such as back injuries, as well as general aches and pains. It would be most advantageous to lift some of the physical burden of filling sand bags in these circumstances. However, the subject invention shares some of the advantages of use of a shovel as the person can in a similar way push the machine into a thicker area of sand 3, so as to convey the sand towards a bag for filling but as the machine carries the material, the strength and energy needed by the person is much less. A motorised version is envisaged, which will still be controlled by hand by the person but additional power provided to assist the moving back and forth. In this form of the invention a motor would be included to help move the machine, with controls on the handle for ready access.

Steel tubing is used for frame 12, with shaping to the steel handle 10 for more comfortable use. Other strong materials could be used instead. Grips and covers can also be used to protect the hands of the user, for more convenient use. Or a shaped plastic or rubber handle can be included. Through pushing forward or back, and tipping the front of the machine into the sand the person can easily find a suitable amount of sand to fill onto the conveyor. A person can also use their feet on frame 12 to add additional strength and support movement in 360 degrees as needed while using the machine.

Conveyor 14 is mounted on frame 12 so that it is carried thereby and moved with the movement of handle 10. Conveyor 14 has conveyor belt 16 on conveyor support plate 17, the conveyor being driven by drive chain 18 powered by petrol engine 20 coupled with reduction gear box 21. As power is supplied the coupled reduction gear box drives the conveyor system moving the conveyor from the front towards the top. Pulley drum 22 supports front part 24 of conveyor belt 16, and pulley drum 26 supports top 28 of conveyor belt 16. It is from this top part that directed flowable material leaves the conveyor to fall under gravity into bag 30 mounted in bag mount 32. The flowable material can be small powder or grain such as sand but could also be gravel or pebbles or anything that can be conveyed to the top and fall into the bag. Different forms of the apparatus may be configured accordingly.

Conveyor belt 16 is a polyurethane belt with fins mounted in the usual manner to carry material directed from point a to point b. The fins pick up and move the flowable material with the movement of the conveyor in a smooth, and continuous action.

Bag mount 32 includes a bag support 34 (as shown ties for bag 30 to bag mount 32) and platform 36 and is a standard hessian bag. Different sizes of platform 36, frame and bag 30 can be used depending on the material. All of these flowable materials may be heavy or dense and so a small bag may be preferred. The bag may be a bag of canvas, or woven plastic suitably strong to hold the material of a typical form used to be loaded with sand or the like. Platform 36 is particularly useful to assist to accommodate different sized bags as it can be moved up and down accordingly. As the height of platform 36 is adjusted, this enables convenient filling of bags of different sizes.

Movement of machine 1 is achieved through use of rear wheels 38 and front wheels 40, which although not powered enable movement forward and back. Part of why the invention is so useful is that it uses the strength of a person but in such a way as it is not as tiring as using a shovel, and much more efficiently. Motorised versions would have similar advantages, as they are likewise manually manipulated but the extra motorisation would reduce fatigue.

Cover 42 covers the flowable material for the majority of the journey on the conveyor so that the maximum volume is able to be captured and bagged. Cover 42 is formed of a thick rubber material in the illustrated example. Material can be fed directly into feed box 44, including manually with a shovel to increase efficiency in which case flap 46 prevents loss of material. Material may also enter through on the conveyor when pushed into the material through flap 46 to be conveyed towards the top. The wide mouth to captures the most material, in this case sand, until it is directed within cover 42. Cover 42 is most useful so that spillage is minimised again improving efficiency. Also, to reduce spillage, side cover 48 can be seen. The covers are useful for additional safety to act against people putting their hands in or close to the conveyor. Likewise flap 46 keeps the moving material away from the user.

Push bar 50 aids pushing the apparatus into the pile of sand, using the strength of the legs of the person, to feed the conveyor. Push bar 50 can be seen located at the convenient lower location so that the person can apply or withdraw their foot as needed.

Useful features as shown include viewing window 52 of chute 54 so the person can see the material flowing in and the filling state of the bag. The bag is clipped or tied in place and the person can see what is happening through viewing window 52, to check that filling through the chute to the bag is happening and to stop as the bag becomes full.

In use, person 3 can push the front of the machine into sand 3 so the material starts to be moved up the conveyor disappearing over entrance 44, and flap 46 prevents the material falling out so it may be conveyed on and up towards the top. Use of adjustable wheels is envisaged so that height clearance can be adjusted to particular applications. This may be useful to adjust the fin distance of the conveyor and the ground, for example. Several of the apparatus may be used at the same time around a sand pile, due to the compact size and easy, hand operated use, a significant advantage over the prior art. It is anticipated for example, that four or more machines could be operating easily around a single sand pile for a significant improvement in efficiency. The invention is useful in small areas to minimise effort and reduce waste as the bags are easily filled.

Overall, the invention is a very useful invention that will replace manual bag filling and loading materials in smaller applications, where it is useful to have a small maneuverable machine to do so. The apparatus removes the potentially harmful bending and straining for manual shoveling and is replaced by an easy to use and efficient apparatus.

Figure 3:
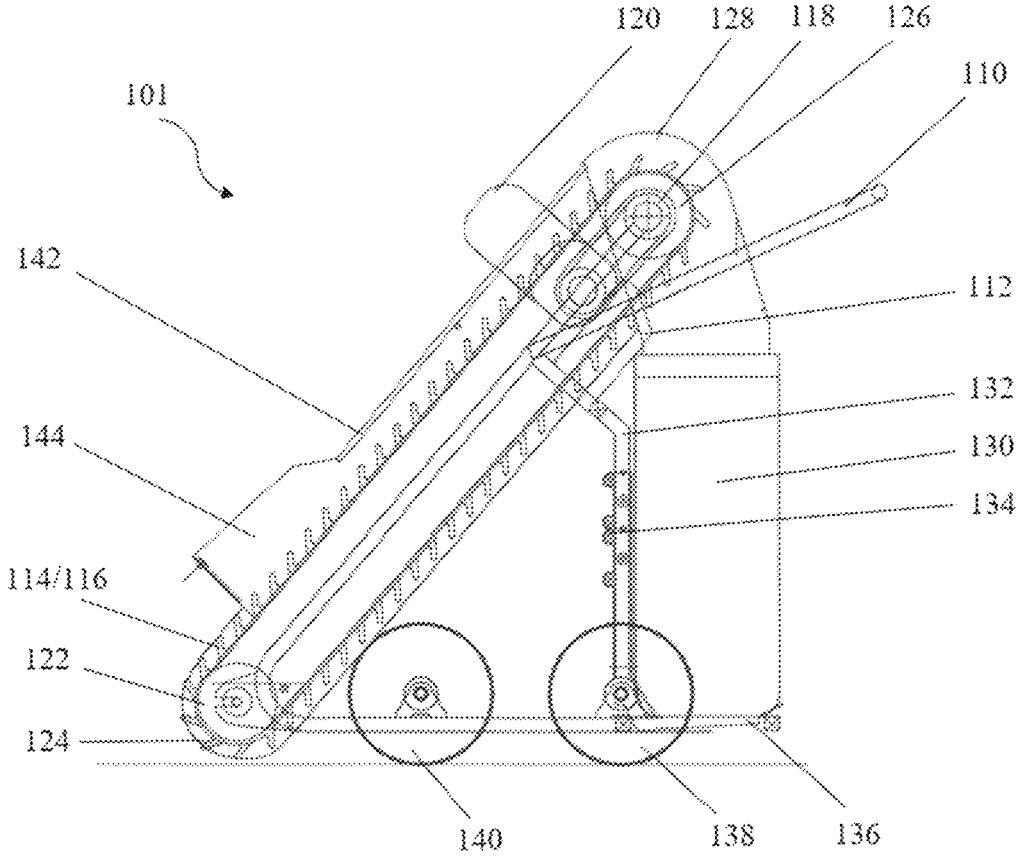
FIG. 3 is a side view of a bag filling machine according to a second preferred embodiment of the invention with the person and sand omitted for ease of illustration.
Figure 4:
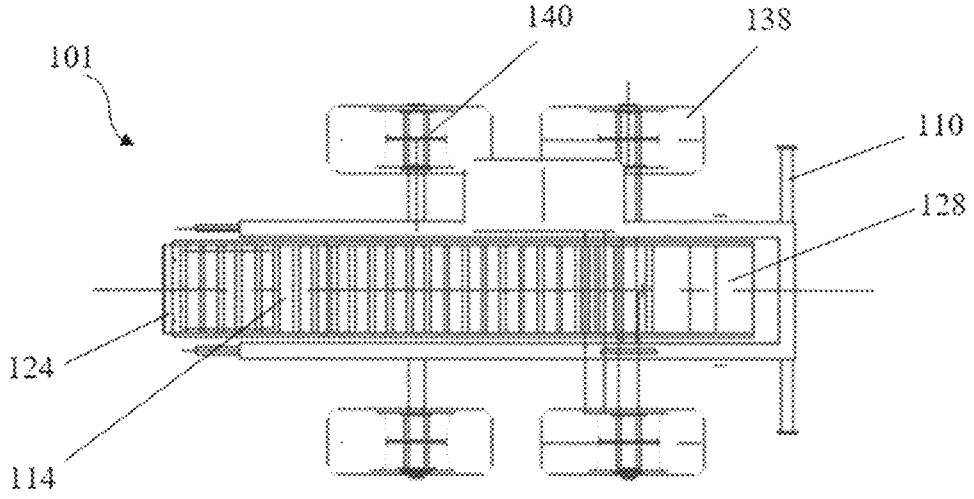
FIG. 4 is a plan view from above of the bag filling machine of FIG. 3.

Referring to FIGS. 3 and 4, a second preferred embodiment of the invention will be described, with similar reference numerals to the first where bag filling machine 101 would be used by a person (not shown) again for individual control. The flowable material is not shown for the second embodiment but again will be a material such as sand (not shown). Bag filling machine 101, has handle 110, connected to frame 112 and it is through handle 110 that the person can easily manipulate and manoeuvre the machine with standard movements. The method of use is as described for the first preferred embodiment.

Steel tubing is used for frame 112, with shaping to the steel handle 110 for more comfortable use. Alternative materials may be used as would be understood. The handle may take any suitable form to facilitate the manual movement to use the machine. The handle is useful to give a full control to the operator.

Conveyor 114 is mounted on frame 112 so that it is carried thereby and moved with the movement of handle 10. Conveyor 114 has conveyor belt 116, conveyor support plate 117, and the conveyor is driven by drive chain 118 powered by petrol engine 120 and connected reduction gear box 121. Pulley drum front 122 supports front part 124 of conveyor belt 116, and pulley drum top 126 supports top 128 of conveyor 116. In the same way, material is caused to enter front of conveyor and be carried up and over the top to fall under gravity to the bag.

Again, bag mount 132 includes a bag support 134 (as shown ties for bag 130 to bag mount 132) and platform 136. Different sizes of platform 136, frame and bag 130 can be used depending on the material. All of these flowable materials may be heavy or dense and so a small bag may be preferred. The bag is shown as a hessian bag. Platform 136 is particularly useful to assist to accommodate different sized bags as it can be moved up and down accordingly.

Movement of machine 101 is achieved through use of rear wheels 38 and front wheels 140, which although not powered enable movement forward and back. Part of why the invention is so useful is that it uses the strength of a person but in such a way as it is not as tiring as using a shovel, and much more efficiently.

Cover 142, feed box 144, flap 146 are all as described for the first embodiment enabling the flowable material to enter and travel the conveyor. Again, the progress of the filling of the bag can be checked the viewing window 152 of chute 154.

The invention is clearly most advantageous and is used in the same way as described for the first embodiment to easily and efficiently fill as many sand bags as are needed, such as in preparation for a storm, cyclone or flood. The illustrated apparatus provides a faster and more efficient way to fill sand bags or the like.

Figure 5:
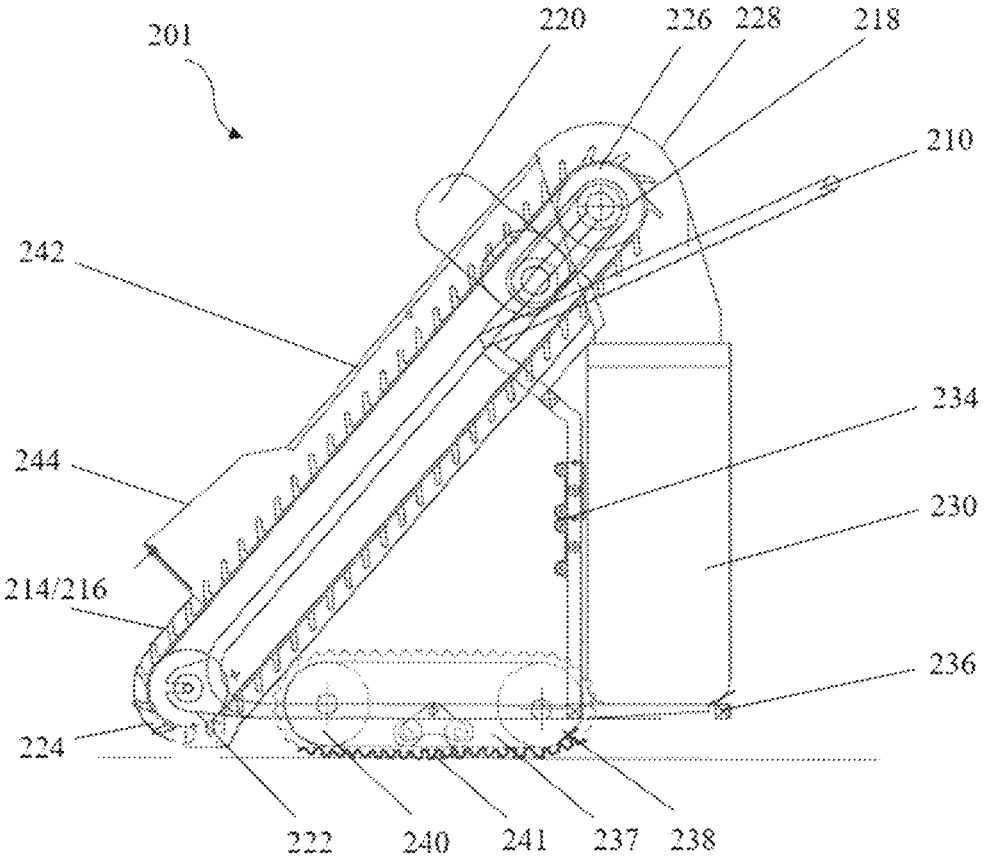
FIG. 5 is a side view of a bag filling machine according to a third preferred embodiment of the invention, with the person and sand omitted for ease of illustration.
Figure 6:
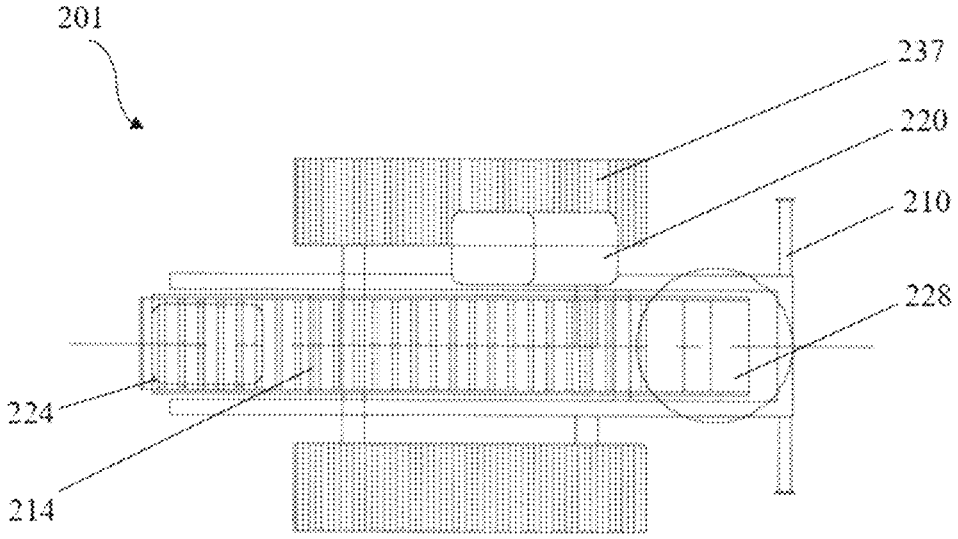
FIG. 6 is a plan view from above of the bag filling machine of FIG. 5.

Referring to FIGS. 5 and 6, a further, third preferred embodiment of the invention will be described, with similar reference numerals to the first and second embodiments, and used in much the same way where bag filling machine 201 would be used by a person (not shown) again for individual control, this time with tracks rather than wheels. The flowable material is not shown for the third embodiment but again will be a material such as sand. Bag filling machine 201, has handle 210, connected to frame 212 and it is through handle 210 that the person can easily manipulate and manoeuvre the machine with standard movements. The method of use is as described for the first preferred embodiment.

Steel tubing is used for frame 212, with shaping to the steel handle 210 for more comfortable use. The handle may take any suitable form to facilitate the manual movement to use the machine. Conveyor 214 as shown is similar to as described elsewhere and is mounted on frame 212 so that it is carried thereby and moved with the movement of handle 210. Conveyor 214 has conveyor belt 216, conveyor support plate 217 all driven by drive chain 218 powered by petrol engine 220 and with reduction gearbox 221. Pulley drum 222 supports front part 224 of conveyor belt 216, and pulley drum top 226 supports top 228 of conveyor 216. In the same way, material is caused to enter front of conveyor and be carried up and over the top to fall under gravity to the bag.

Again, bag mount 232 includes a bag support 234 (as shown ties for bag 230 to bag mount 232) and platform 236. Different sizes of platform 236, frame and bag 230 can be used depending on the material. All of these flowable materials may be heavy or dense and so a small bag may be preferred. The bag may be a standard material bag, of canvas, or woven plastic suitably strong to hold the material. Platform 236 is particularly useful to assist to accommodate different sized bags as it can be moved up and down accordingly.

Movement of machine 201 is achieved through use of rear wheels 38 and front wheels 240 in tracks 237. Track 237 allow easy movement over any ground surface include in mud, rough ground, or where there is not clear path. Away from town, such as on a farm, or in a time of disaster where paths are not clear the use of tracks 237 will be most useful.

Cover 242, feed box 244, flap 246 all work as described for the other embodiments to capture and contain the flowable material so that it is conveyed to the top and over to the bag. Viewing window 252 of chute 254 are useful inclusions to monitor the bag filling as it happens.

Use of the tracks instead of just wheels in the other forms of the invention will allow use in different environments, such as on a farm or off road where wheels may be not be able to be used.

Figure 8:
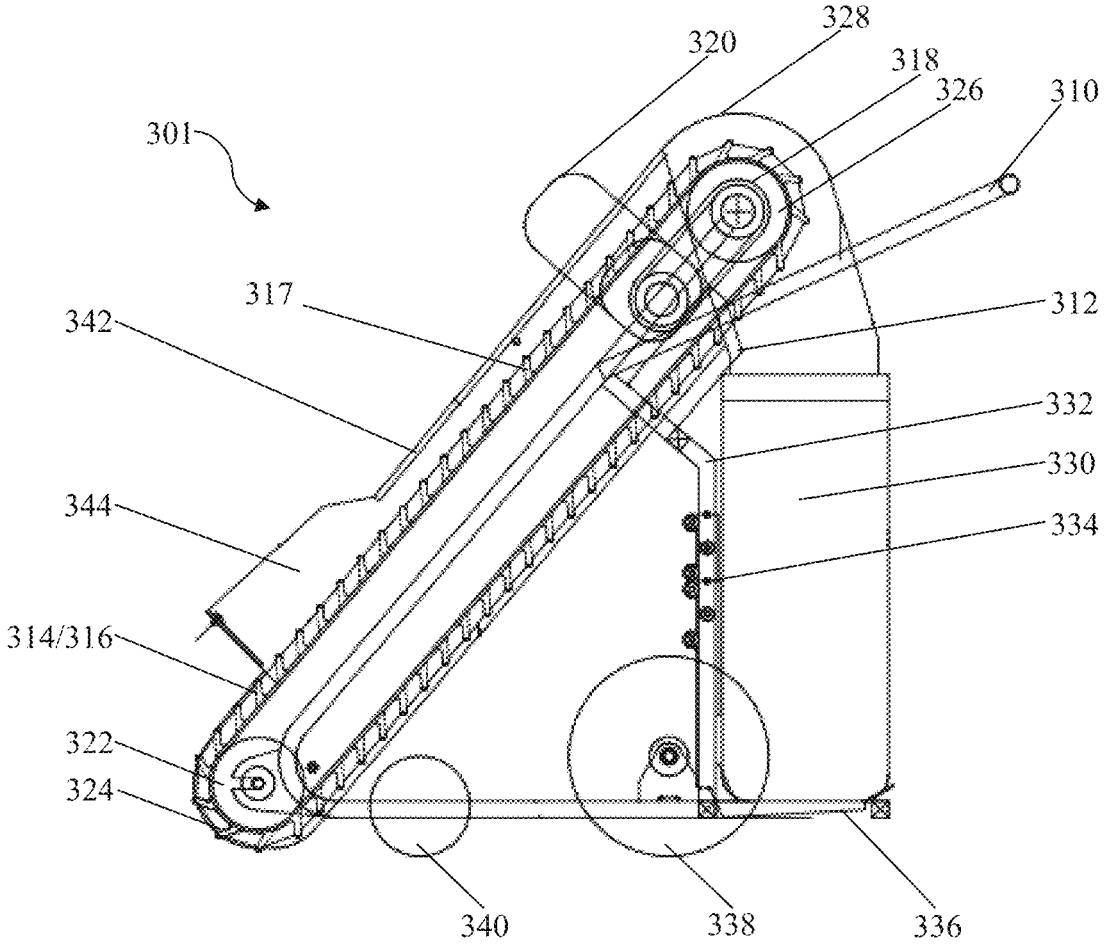
FIG. 8 is a side view of a bag filling machine according to a fourth preferred embodiment of the invention, very similar to the first but with updated design including pockets cast into the conveyor belt for collection of the material on the conveyor, with the person and sand omitted for ease of illustration.
Figure 9:
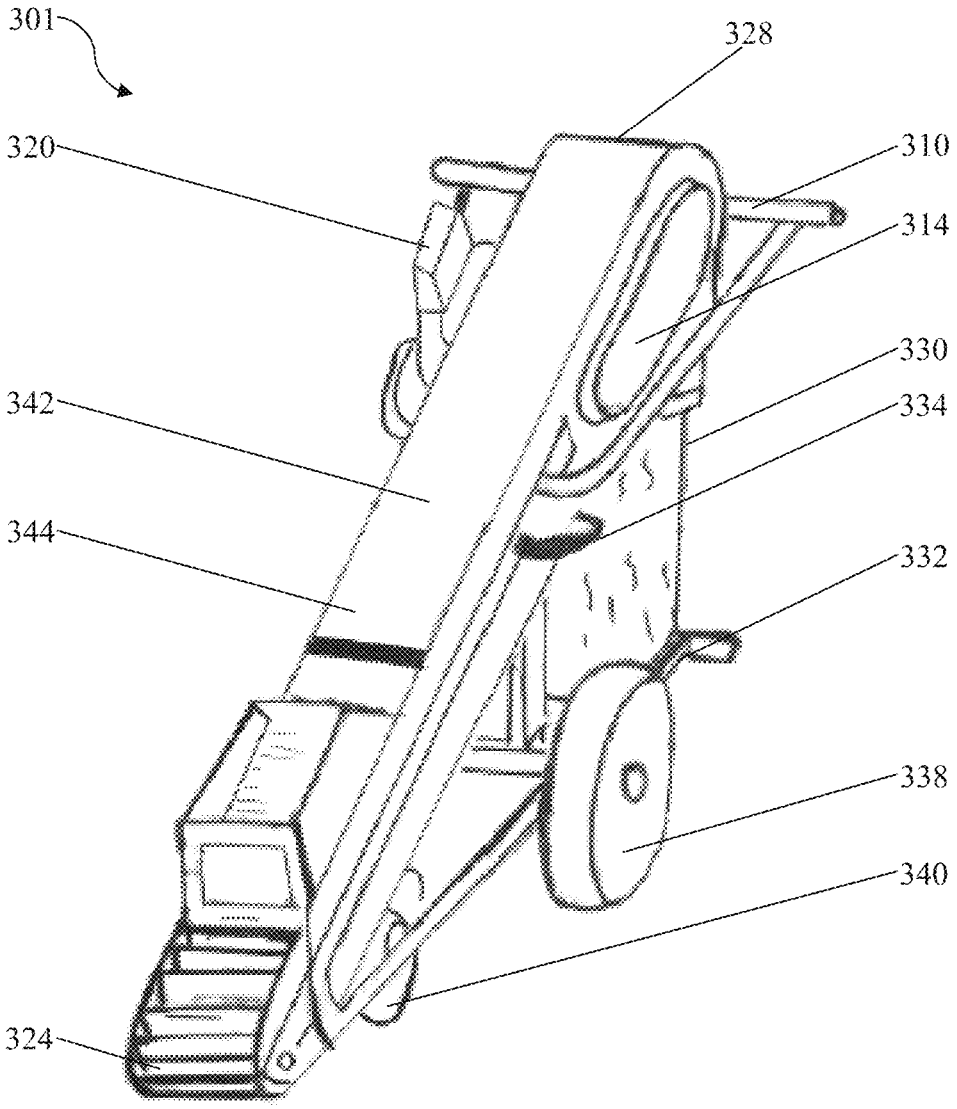
FIG. 9 is a schematic perspective view of the invention of FIG. 8 showing the front of the machine which will contact and capture material in the pockets.

Referring to FIGS. 8 and 9, a further, fourth preferred embodiment of the invention will be described, with similar reference numerals to the first, second and third embodiments, and used in much the same way where bag filling machine. For the fourth embodiment the improvement to the pockets as these are cast into the conveyor so that as the machine moves into the material it can readily capture and move the material. Bag filling machine 301, for use by a person to move back and fourth into a pile of material to pick up the material automatically with the machine, to be bagged until sufficient bags are filled. The invention is particularly useful for sand, but the material could be anything it is needed to bag up, it could be gravel, powder for example. Sand bagging is a really useful application of the invention but for commercial uses a person may go and bag their own material such as dry garden materials, or even building materials. The usefulness of the invention and the wide range of applications should not be overlooked.

Bag filling machine 301, has handle 310, connected to frame 312 and it is through handle 310 that the person can easily manipulate and move the bag machine to effectively fill bags. Pushing down can allow full manipulation as described elsewhere. Frame 312 with handle 310 form the strong support basis for the machine to enable manipulation by a person by hand without the need for a vehicle engine or movement. Other forms and arrangements may be used instead.

Steel tubing is used for frame 312, with shaping to the steel handle 310 for more comfortable use. A person push and rotate frame 312 to add additional strength and support movement in 360 degrees as needed while using the machine.

Conveyor 314 is mounted on frame 312 so that it is carried thereby and moved with the movement of handle 310. Conveyor 314 has conveyor belt 316 on conveyor support plate (not labelled), the conveyor being driven by drive chain 318 powered by petrol engine 320 coupled with reduction gear box (not labelled). As power is supplied the coupled reduction gear box drives the conveyor system moving the conveyor from the front towards the top. Pulley drum 322 supports front part 324 of conveyor belt 316, and pulley drum 326 supports top 328 of conveyor belt 316. It is from this top part that directed flowable material leaves the conveyor to fall under gravity into bag 330 mounted in bag mount 332. Other forms of power and control to the conveyor could be used in alternative forms of the invention.

Conveyor belt 316 is a polyurethane belt, and in this form of the invention instead of fins, includes pockets 317 cast into conveyor belt 316 and so carried therewith on operation of the machine. The pockets 317 are sized to readily capture material, carry the material and not to loose it on the way up. Having a smaller pocket 317 of 30 to 50 millimetres assists to rapidly and efficiently carry the material from the front of the machine up to be bagged. Smaller or larger pockets 317 can be used instead. A conventional straight conveyor could not capture the material, but through use of these inventive pockets 317 small incremental portions of the flowable material are taken from the pile and carried up and directed away for bagging.

Bag mount 332 includes a bag support 334 (as shown ties for bag 330 to bag mount 332) and platform 336 and is a standard hessian bag. Different sizes of platform 336, frame and bag 330 can be used depending on the material. All of these flowable materials may be heavy or dense and so a small bag may be preferred. The bag may be a bag of canvas, or woven plastic suitably strong to hold the material of a typical form used to be loaded with sand or the like. Platform 336 is particularly useful to assist to accommodate different sized bags as it can be moved up and down accordingly. As the height of platform 336 is adjusted, this enables convenient filling of bags of different sizes.

Movement of machine 1 is achieved through use of rear wheels 338 and front wheels at location 340, which although not powered enable movement forward and back. Part of why the invention is so useful is that it uses the strength of a person but in such a way as it is not as tiring as using a shovel, and much more efficiently. Motorised versions would have similar advantages, as they are likewise manually manipulated but the extra motorisation would reduce fatigue.

Cover 342 covers the flowable material for the majority of the journey on the conveyor so that the maximum volume is able to be captured and bagged. Cover 342 is formed of a thick rubber material in the illustrated example. Material can be fed directly into feed box 344, including manually with a shovel to increase efficiency in which case flap 346 prevents loss of material. Material may also enter through on the conveyor when pushed into the material through flap (not labelled) to be conveyed towards the top. The wide mouth to captures the most material, in this case sand, until it is directed within cover 342.

The use of the capturing pockets in the conveyor is advantageous to maximise the capture and retaining of the flowable material to quickly move material from the pile on the ground to the bag.

In all forms of the invention the person can easily turn on the motor and start the movement of the conveyor in the usual way. The covered section prevents accidental loss of the material making the system efficient. Then the person can use their own strength to push the front of the conveyor into the material which can then start to be conveyed up to the top. As the material reaches the top if falls into the bag and once full the bag removed and sealed. Multiple bags can be quickly and easily filled in this way.

The inventor has through careful development provided an invention that surprisingly addresses a problem that has not been solved until now.

INDUSTRIAL APPLICABILITY

The machine may be manufactured industrially and supplied either direct to government or other organisations, or to retailers or wholesalers.

It will be apparent to a person skilled in the art that changes may be made to the embodiment disclosed herein without departing from the spirit and scope of the invention in its various aspects.

REFERENCE SIGNS LIST

| | |
|---|---|
| 1 | Bag Filling Machine |
| 2 | Person |
| 3 | Sand |
| 10 | Handle |
| 12 | Frame |
| 14 | Conveyor |
| 16 | Conveyor Belt |
| 17 | Conveyor Support Plate |
| 18 | Drive Chain |
| 20 | Petrol Engine |
| 21 | Reduction Gear Box |
| 22 | Pulley Drum |
| 24 | Front of 16 |
| 26 | Pulley Drum |
| 28 | Top of 16 |
| 30 | Bag |
| 32 | Bag Mount |
| 34 | Bag Support |
| 36 | Platform |
| 38 | Rear Wheels |
| 40 | Front Wheels |
| 42 | Cover |
| 44 | Feed box |
| 46 | Flap |
| 48 | Side cover |
| 50 | Push bar |
| 52 | Viewing Window |
| 54 | Chute |
| 101 | Bag Filling Machine |
| 110 | Handle |
| 112 | Frame |
| 114 | Conveyor |
| 116 | Conveyor Belt |
| 117 | Conveyor Support Plate |
| 118 | Drive Chain |
| 120 | Petrol Engine |
| 121 | Reduction Gear Box |
| 122 | Pulley Drum |
| 124 | Front of 116 |
| 126 | Pulley Drum |
| 128 | Top of 116 |
| 130 | Bag |
| 132 | Bag Mount |
| 134 | Bag Support |
| 138 | Rear Wheels |
| 140 | Front Wheels |
| 142 | Cover |
| 144 | Feed box |
| 146 | Flap |
| 148 | Side cover |
| 150 | Push bar |
| 152 | Viewing Window |
| 154 | Chute |
| 201 | Bag Filling Machine |
| 210 | Handle |
| 212 | Frame |
| 214 | Conveyor |
| 216 | Conveyor Belt |
| 217 | Conveyor Support Plate |
| 218 | Drive Chain |
| 220 | Petrol Engine |
| 221 | Reduction Gear Box |
| 222 | Pulley Drum |
| 224 | Front of 216 |
| 226 | Pulley Drum |
| 228 | Top of 216 |
| 230 | Bag |
| 232 | Bag Mount |
| 234 | Bag Support |
| 236 | Platform |
| 237 | Tracks |

-continued

| | |
|---|---|
| 238 | Rear Wheels |
| 240 | Front Wheels |
| 241 | Caterpillar Tracks |
| 242 | Cover |
| 244 | Feed box |
| 246 | Flap |
| 248 | Side cover |
| 250 | Push bar |
| 252 | Viewing Window |
| 254 | Chute |
| 301 | Bag Filling Machine |
| 310 | Handle |
| 312 | Frame |
| 314 | Conveyor |
| 316 | Conveyor Belt with cast in pockets |
| 318 | Drive Chain |
| 320 | Petrol Engine |
| 322 | Pulley Drum |
| 324 | Front of 16 |
| 326 | Pulley Drum |
| 328 | Top of 16 |
| 330 | Bag |
| 332 | Bag Mount |
| 334 | Bag Support |
| 336 | Platform |
| 338 | Rear Wheels |
| 340 | Front Wheels |
| 342 | Cover |
| 344 | Feed box |

What is claimed is:

1. A container filling machine for use by a person to fill bags of a flowable material, the container filling machine comprising:

a hand control; and a conveyor belt, the conveyor belt being a polyurethane conveyor belt having a plurality of material capturing pockets cast into the conveyor belt, the conveyor belt including a first part for contact with a flowable material located in a first location and configured to capture the flowable material in at least one of the plurality of material capturing pockets and direct and move the flowable material towards a second part located at a top of the conveyor belt;

wherein, a person can move the first part of the conveyor belt into contact with the flowable material by moving by hand the container filling machine into contact, and the conveyor belt moves the flowable material from the first location towards a second location where a container is filled, and wherein the flowable material is sand.

2. The container filling machine of claim 1, wherein the container is a bag in fluid communication with the second part of the conveyor belt and able to receive flowable material therefrom to fill the bag.

3. The container filling machine of claim 1, wherein the hand control includes a handle held by a hand of the person and wherein the person can control individually the container filling machine, including pushing and pulling and 360 degrees full maneuverability, to fill the container.

4. The container filling machine of claim 1, wherein the flowable material is directed upwards from a front end of the conveyor belt towards the second location where the container is filled.

5. The container filling machine of claim 1, wherein the flowable material is directed from a front end of the conveyor belt towards a top end of the conveyor belt and at the top end of the conveyor belt the flowable material may flow under gravity into the container.

6. The container filling machine of claim 1, wherein the plurality of material capturing pockets are each cast substantially along the length of the conveyor belt, whereby as the conveyor belt runs when a front end of the conveyor belt is in contact with the flowable material, the flowable material is captured in the plurality of material capturing pockets continually, and directed away from the front end of the conveyor belt.

7. The container filling machine of claim 1, wherein the conveyor belt includes a cover or protective part configured such that as flowable material is captured from a front end of the conveyor belt and directed away from the front end of the conveyor belt, the cover or protective part retaining the captured flowable material.

8. A bag filling machine for use by a person to fill bags of a flowable material, the bag filling machine comprising:

a hand control, to operate the bag filling machine on or off, including operating wheels or caterpillar tracks powered by a motor to move the bag filling machine forward or back on control; and a conveyor belt, the conveyor belt being a polyurethane conveyor belt having a plurality of material capturing pockets cast into the conveyor belt, and the conveyor belt controlled by the hand control to cause the conveyor belt to run, and the conveyor belt including a first part for contacting the plurality of material capturing pockets with a flowable material in a first location, and configured to capture the material in the plurality of material capturing pockets and direct and move the flowable material upwards towards a bagging area in a second part of the conveyor where the flowable material can fall under gravity into a bag below;

wherein, a person can move the first part of the conveyor belt into contact with the flowable material by moving by hand the bag filling machine into contact, and the conveyor belt moves the flowable material from the first location towards the second location where the bag may be filled and removed, and wherein the flowable material is sand.

* * * * *